United States Patent [19]

Bond et al.

[11] Patent Number: 4,685,504

[45] Date of Patent: Aug. 11, 1987

[54] FOUNDRY SAND FEEDING APPARATUS

[75] Inventors: Robert H. Bond; Richard B. Kraus, both of Barrington, Ill.

[73] Assignee: General Kinematics Corporation, Barrington, Ill.

[21] Appl. No.: 869,451

[22] PCT Filed: Oct. 30, 1984

[86] PCT No.: PCT/US84/01738

§ 371 Date: Dec. 5, 1984

§ 102(e) Date: Dec. 5, 1984

[87] PCT Pub. No.: WO86/02582

PCT Pub. Date: May 9, 1986

Related U.S. Application Data

[63] Continuation of Ser. No. 690,482, Dec. 5, 1984, abandoned.

[51] Int. Cl.[4] ..... B22C 15/10

[52] U.S. Cl. ..... 164/203; 164/5; 164/34; 164/192; 164/202

[58] Field of Search ..... 164/5, 19, 20, 34, 38, 164/39, 169, 192, 200, 201, 202, 203, 37

[56] References Cited

U.S. PATENT DOCUMENTS

| | | | |
|---|---|---|---|
| 823,530 | 6/1906 | Hewlett | 164/202 |
| 2,636,230 | 4/1953 | Morton | 164/202 |
| 2,789,325 | 4/1957 | McKee | 164/202 |
| 3,446,265 | 5/1969 | Buck, Jr. | 164/39 |
| 3,540,521 | 11/1970 | Buck, Jr. | 164/37 |
| 4,089,081 | 5/1978 | Jacob | 164/5 |

FOREIGN PATENT DOCUMENTS

| | | | |
|---|---|---|---|
| 967096 | 8/1964 | United Kingdom | 164/192 |

*Primary Examiner*—Nicholas P. Godici
*Assistant Examiner*—Richard K. Seidel
*Attorney, Agent, or Firm*—Wood, Dalton, Phillips, Mason & Rowe

[57] ABSTRACT

According to the invention, a sand distribution structure is interposed between a sand supply hopper and a flask having an associated pattern. The sand distribution structure comprises juxtaposed, apertured plates, which are adjustable relative to each other to variably register the apertures in the separate plates. It is possible with variations in the dimensions and locations of the apertures in the plates to choose a desired flow rate and/or selectively disperse the sand over the pattern.

4 Claims, 10 Drawing Figures

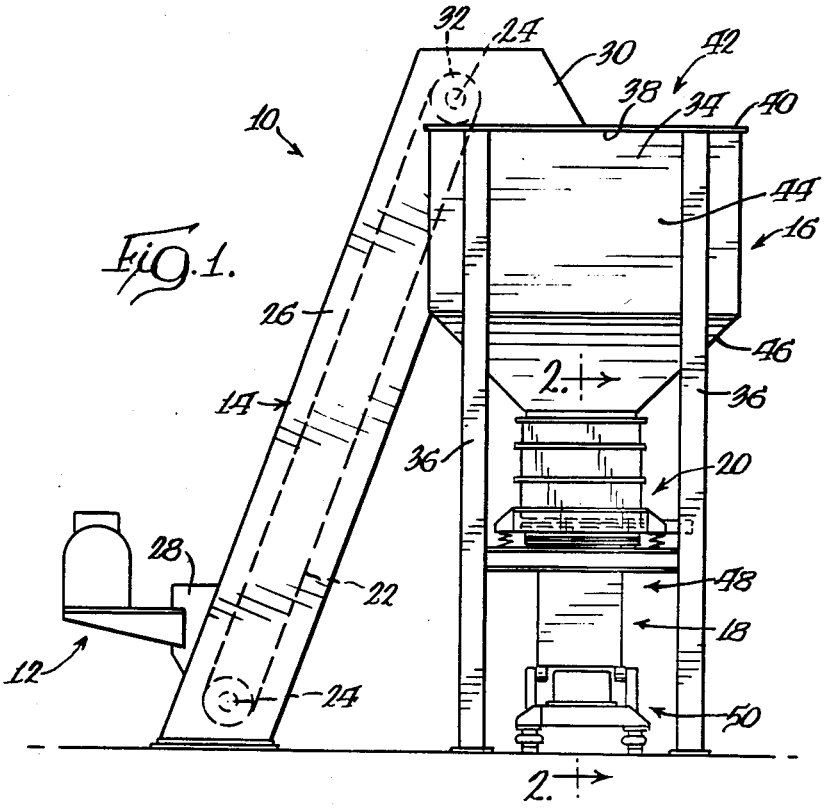
Fig. 1.
Fig. 3.
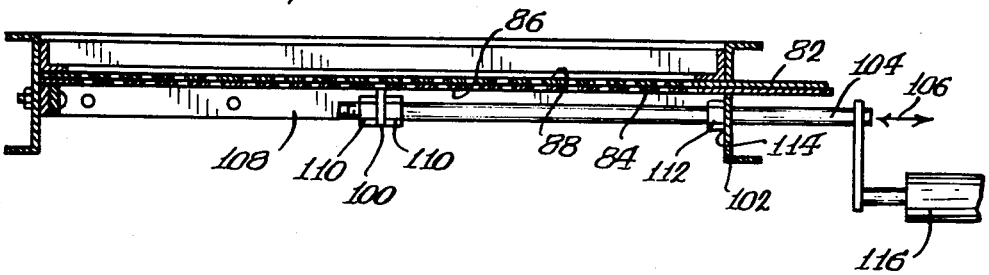

16
146
138
142
144
146
78
80
80
76
80
80
96
94
3.
94
92
10
90
98
148
148
118
3.
150
150
72
120
152
81
81
66
70
48
68
53
52
56
54
64
60
50
144
62
62
146
143
140
146

FOUNDRY SAND FEEDING APPARATUS

This application is a continuation of application Ser. No. 690,482 filed Dec. 5, 1984 now abandoned.

BACKGROUND OF THE INVENTION

1. Field of the Invention

This invention relates to apparatus for forming casting molds and, more particularly, to a structure for controlling delivery of sand into a flask to define such a mold.

2. Background Art

A known metal forming process employs a sand mold into which molten metal is poured and cast. Typically, a pattern, representing a desired part configuration, is situated within a flask or mold. Sand is tamped or packed about the pattern to reproduce its contour, whereupon the pattern is removed. The molten metal introduced to the mold assumes the shape of the cavity.

It is known to form the patterns from STYROFOAM, which is economically more feasible than the use of wood patterns, which is common. The STYROFOAM pattern has the further advantage that it will exhaust as a gas through a system of risers and gates upon introduction of the molten material to the mold, and will not leave a residue that might compromise the quality of the casting.

To assure that the sand completely duplicates the contour of the pattern and does not bridge or hang up, which might prevent its passage into tight crevices, one practice in the art has been to compress the sand against the pattern. One such apparatus that operates in this manner is shown in U.S. Pat. No. 3,234,601, to Hatch et al. In Hatch et al a pneumatically operated squeeze ram is used to compact the mold.

The principal drawback with this type of mold formation is that it is impractical where a delicate pattern such as one having a slender protrusion or finger, is used or STYROFOAM makes up the pattern. The pattern might bend, curl and/or be destroyed under the impact of the compressing cylinder. The use of a ceramic coating over the STYROFOAM to enhance its stability alleviates but does not eliminate the problem of pattern alteration. Any change in the pattern results in an inferior and/or unacceptable casting.

An alternative to the compression type mold formation is the provision of a vibratory apparatus that is operable to vibrate the flask and pattern and cause an even distribution and compaction of sand around the pattern. While this particular process is generally acceptable, one still contends with the problem of pattern breakage upon the sand encountering the pattern.

In a typical apparatus, a hopper is disposed above the flask and associated pattern. Generally, in most apparatus, the sand rains freely over the pattern. With nothing to interrupt the hopper flow, the incoming sand may break off portions of the pattern. Reduction of the flow rate to the flask, while preventing damage to certain delicate portions of the pattern, slows the entire operation and results in a bottleneck in the assembly line. The economic consequences are apparent.

The present invention is specifically directed to overcoming the above enumerated deficiencies in a novel and simple manner.

SUMMARY OF THE INVENTION

According to the present invention a sand distribution structure is provided beneath a supply hopper for controlling delivery of sand over a pattern in a flask. The invention has as its principal objective the delivery of sand to the pattern at a rate commensurate with the ability of the pattern to withstand impact from the sand. The mold can thus be formed at the most rapid rate without the risk of damaging the pattern.

To accomplish this end, first and second apertured plates are provided and are adjustably mounted relative to each other so that selective registration can be effected between the apertures to define a sand flow passage therethrough. The size and location of the apertures on the plates can be varied to choose a desired flow rate, mask a portion of the pattern entirely from the direct flow of sand and/or choose different sand flow rates over different portions of the pattern.

In another aspect of the invention, vibratory apparatus are provided and independently operable to separately vibrate the hopper and flask. The hopper vibration assures that a constant and continuous flow of sand is directed from the hopper to the plates. The vibration of the flask cooperates with the plates controlling the delivery of sand to effect uniform compaction of sand about the pattern.

Other objects and advantages of the invention will be apparent upon reading the following detailed description taken in conjunction with the drawings and the appended claims.

DESCRIPTION OF THE DRAWINGS

FIG. 1 is an elevation view of a vibratory sand and casting handling system having incorporated therein a preferred form of said distribution control according to the invention;

FIG. 3 is a fragmentary, sectional view of adjustable plates associated with the sand distribution control along line 3—3 of FIG. 2;

BEST MODE FOR CARRYING OUT THE INVENTION

Figure 2:
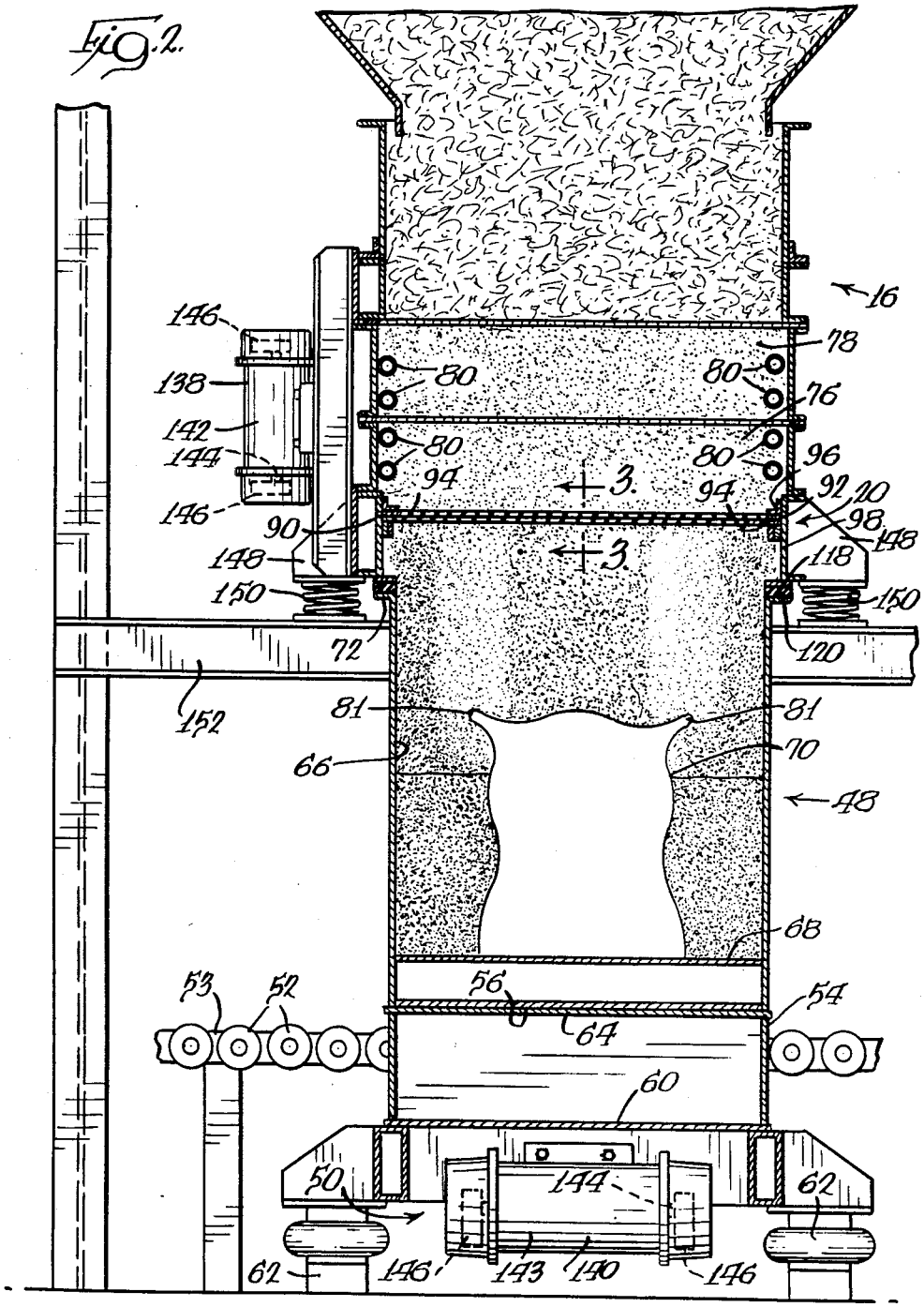
FIG. 2 is a fragmentary, sectional view of the sand distribution control along line 2—2 of FIG. 1.

An exemplary sand and casting handling system is shown at 10 in FIG. 1. This system is representative of the environment wherein the present invention is particularly suitable. Generally, the system 10 of FIG. 1 comprises a sand classifier station at 12, a delivery conveyor 14, a supply hopper 16, a flask support station at 18 and a sand distribution section at 20, which is primarily whereat the present invention resides.

At the sand classifier station 12, a desired particulate size is admitted to the delivery conveyor 14. The delivery conveyor 14 comprises a vertically directed, endless conveyor 22 rotating about spaced pulleys 24. The conveyor 22 operates within an enclosed shroud 26 and advances sand from an inlet 28, adjacent the sand classifier near the bottom of the shroud, towards a shroud cap 30. The particulate falls off the upper edge 32 of the conveyor and into a bin 34 associated with the hopper. The cap 30 intercepts stray particulate and diverts the same into bin 34.

The bin 34 is supported independently by four upright columns 36 which bear beneath an upper rim 38 at the upper edge 40 bounding the upper inlet 42 of the bin. The bin has a main body 44 with a constant cross-sectional area. An integral, tapered chamber 46 funnels material from the body 44 to the flask 48, which is supported on an elevating apparatus at 50.

The details of the system with which the invention is operable are shown clearly in FIG. 2. In practice, the system 10 comprises a single station along a casting assembly line. The flask 48 is transported between stations by equipping the same with rails (not shown) which are guided along serially arranged rollers 52 rotatably carried on a supporting frame 53 and cooperatively defining a predetermined guide path. The flask is raised to its operative position shown in FIG. 2 and lowered therefrom by a platform 54 bearing on the underside 56 of the flask and having associated therewith the elevating mechanism at 50. The elevating mechanism 50 comprises a frame 60 which is selectively raised and lowered by four pneumatic lifts 62 which are of conventional construction.

To remove the flask 48 from its FIG. 2 position, the pneumatic lifts are actuated to lower the frame 60, causing the rail associated with the flask to bear on the rollers 52. The flask is shuttled away by an appropriate mechanism and a new flask 48 substituted in its stead. With the new flask 48 situated in aligned relationship beneath the hopper, an upwardly facing wall 64 of the frame 50 is aligned facially with the underside 56 of the flask. The frame 60 is elevated through the pneumatic lifts 62, separated from the rollers 52 and caused to be engaged with the bottom portion of the sand distribution section 20.

The flask 48 comprises a cup-shaped chamber 66 with a bottom wall 68 which supports a representative pattern 70 shown in FIG. 2 made preferably of STYROFOAM or the like. The chamber has an outwardly turned peripheral rim 72 which abuts the bottom of the sand distribution section 20.

Immediately above the sand distribution section are sand cooling chambers 76, 78. In each of the chambers 76, 78 cooling coils 80 are provided for circulating air through the sand bed therewithin. This is required because the sand is often reused in several foundry operations and may be admitted to the hopper at an elevated temperature after a prior use. Cooling assures that the temperature of the sand is sufficiently low that it will not cause thermal damage to the chamber or sand distribution section.

In conventional operation, sand from the hopper is rained uninterruptedly over the pattern 70. While the pattern configuration in FIG. 2 is generally of sufficient strength to withstand most of the impact, the oppositely extending fingers 81 are very delicate. Under the load of the incoming sand, the fingers 81 are extremely susceptible to breakage.

This problem is obviated by the inclusion of the sand distribution structure 20, which is detailed in FIGS. 3–10. The sand distribution section 20 comprises a first fixed plate 82 and a second plate 84 adjustably mounted relative to the fixed first plate 82. The first and second plates are both flat and have adjacent surfaces 86, 88, which facially abut each other with the plates in sliding, juxtaposed relationship. Within each of the plates are apertures which allow passage of sand. By adjusting the second plate relative to the first plate, the desired amount of registration between the apertures can be selected. The particular configuration and arrangement of the apertures is shown in FIGS. 4–10 and will be discussed below.

Returning to the basic structure in FIGS. 2 and 3, the first plate 82 is shown attached adjacent opposite edges 90, 92 to the undersides 94 of angled pieces 96 secured rigidly to a supporting frame 98 associated with the sand distribution control.

The second plate 84 has depending flanges 100, 102 which are bored through a common line to accept a control rod 104. The plate 84 is supported lengthwise, on its edges extending parallel to the line of adjusting movement indicated by the double ended arrow 106, by angle brackets 108 attached to the supporting frame 98. The second plate is fixed in a desired position by threadably attaching nuts 110 on opposite sides of the flange 100 to the rod 104. With the plates at a desired setting, the nuts 110 are drawn towards each other to captively surround the flange 100 and fix the position of the rod 104. A separate nut 112 is provided threadably on the rod to abut the face 114 of the flange 102 associated with the second plate. To adjust the second plate relative to the first plate, the nuts 110, 112 are released and the plate moved axially along the rod in either direction indicated by the arrow 106 until a desired flow condition is attained. The nuts are then drawn up with the relative plate positions established.

A shut off actuator 116 is associated with the plate 84 to shift the plate back and forth between a fully blocked position and the set position described in the prior paragraph. Normally flow of sand is arrested as the flask is moved to and away from its station 10.

Associated with the supporting frame 98 is a fixed, integral rim 118 which conforms substantially to the rim 72 on the flask chamber. The rims 72, 118 abut and seal the flask chamber 66 with the flask chamber in operative position beneath the hopper. To establish an effective seal that keeps foreign matter out of the flask and accommodates multi-dimensional relative movement between the flask and hopper section, a soft, enlarged gasket 120 is interposed between the rims 72, 118 and compressibly held captive therebetween.

Figure 4:
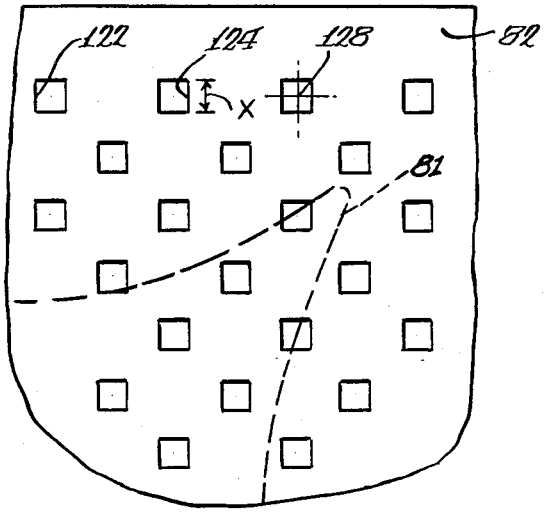
FIG. 4 is a fragmentary, plan view of one of the sand distribution plates that is fixed in relationship to the apparatus and shown in relationship to a pattern therebeneath in phantom.

The details of the apertures in the plates 82, 84 will be described relative to FIGS. 4–10. The first plate 82 is shown in FIG. 4 in relationship to one of the underlying pattern fingers 81. Each aperture 122 is square and bounded by edges 124 having a length X. The apertures 122 are arranged in rows with each row offset from the next adjacent row an equal distance both lengthwise of the rows and perpendicularly thereto.

Figure 5:
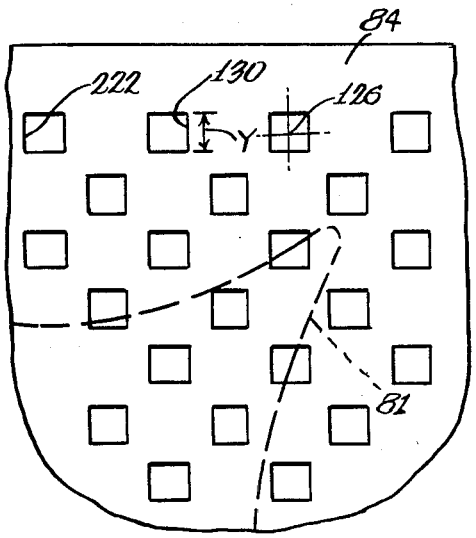
FIG. 5 is a plan view of an adjustable plate used in conjunction with the plate of FIG. 4 to adjustably define a sand passageway through the sand distribution apparatus.

One arrangement for the apertures 222 in the second plate 84 is shown in FIG. 5. Each of the apertures 222 is square with centers 126, corresponding in location to the centers 128 of the apertures 122 in the first plate 82. The dimension of the edges 130 defining the apertures 222 is identified as Y in FIG. 5. The length Y is slightly larger than the dimension X of the apertures 122 on plate 82.

Figure 6:
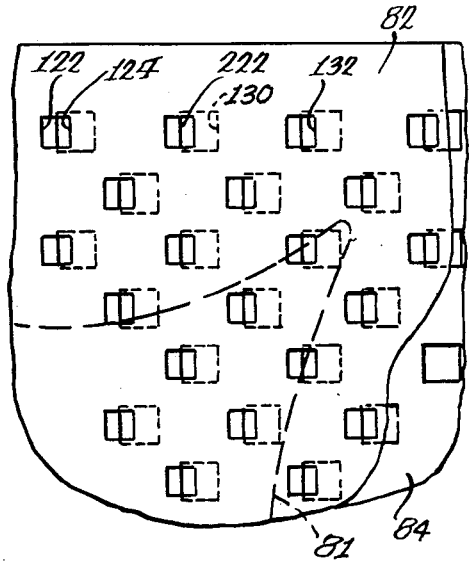
FIG. 6 is a plan view of the plates of FIGS. 4 and 5 with the plates in operative relationship with respect to each other and the underlying pattern.

FIG. 6 depicts the plates 82, 84 in juxtaposed relationship and with the apertures 122, 222 in partial registration. It can be seen that the edges 124, 130 are substantially parallel so that complete registration of the apertures 122 can be accomplished with the larger aperture 222 of the second plate. The flow passage 132 defined by the registered apertures is adjustable between a fully blocked position and a completely registered position wherein the sand passage area is equal to the area of aperture 122, which is the smaller aperture. The flow rate can be chosen according to need and is substantially uniform throughout the area beneath the plates.

Figure 7:
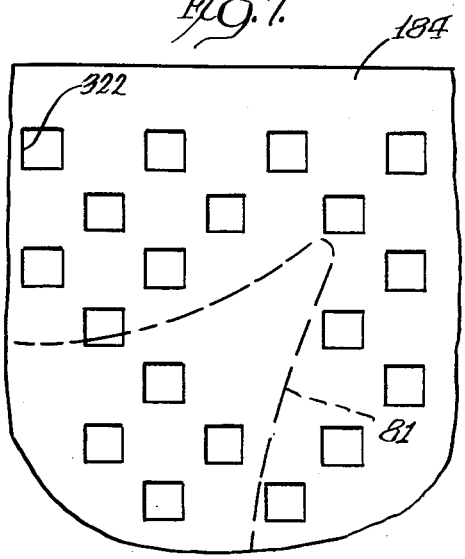
FIG. 7 is a plan view of an alternative structure for the adjustable plate of FIG. 5.
Figure 8:
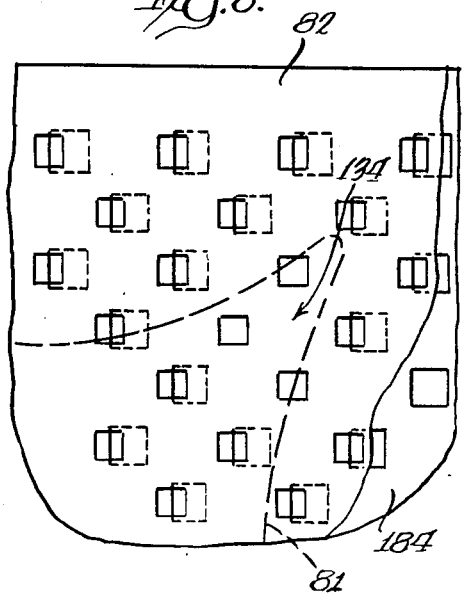
FIG. 8 is a plan view of the plates in FIGS. 4 and 7 in operative relationship with each other and the underlying pattern.

FIG. 7 depicts an alternative construction 184 to that in FIG. 5 for the second plate 84. The apertures 322 are configured substantially identically to those in FIG. 5 and oriented in the same manner. However, three apertures immediately above the finger 81 are omitted so as to mask the region above the finger. By viewing FIG. 8, which shows the plates 82, 184 in operative, juxtaposed relationship, it can be seen that the flow will be substantially uniform and the same as that in FIG. 6 everywhere but at the blocked region at 134. By blocking the sand flow, the fingers 81 are protected from the downcoming sand. The sand is distributed around the fingers and builds up progressively from the region around the finger towards the finger. While three apertures 322 are omitted in the FIG. 7 plate 184, any number may be eliminated depending on the particular configuration of the pattern.

Figure 9:
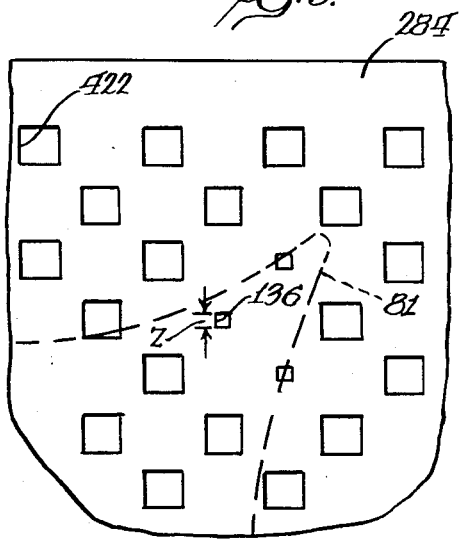
FIG. 9 is a plan view of a still further alternative to the adjustable plate construction of FIG. 5.
Figure 10:
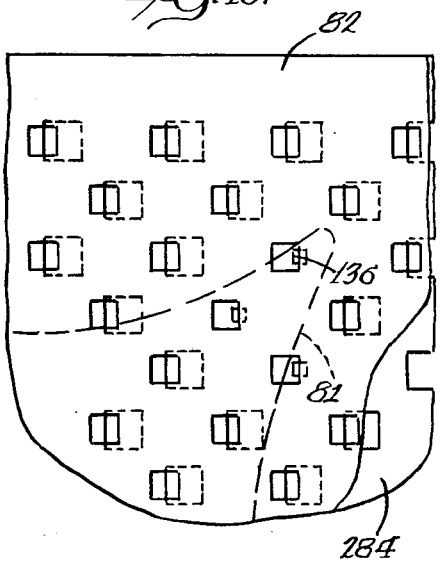
FIG. 10 is a plan view with the plates in FIG. 4 and 9 in operative relationship with respect to each other and the underlying pattern.

In FIG. 9, the apertures 422 correspond in configuration and orientation to the apertures 222, 322 in FIGS. 5 and 7 respectively. However, rather than eliminating the apertures in the vicinity of the finger 81, smaller apertures 136 are substituted in their stead. The apertures 136 have a defining edge dimension Z that is less than both X and Y in the previous constructions. The relative positions of modified plate 284 in FIG. 9 and plate 82 in FIG. 4 is shown with the same in operative, juxtaposed relationship. It can be seen that the smallest apertures 136 is the limiting passage area and will account for a much smaller rate of flow over the fingers than will occur over the remainder of the flask. In the process, the fingers are protected from the heavy direct flow of sand, while buildup around the fingers occurs. The sand introduction other than over the fingers, can occur at a rapid rate.

A further aspect of the invention is the provision of independent vibratory means 138, 140, respectively on the supporting frame 98 associated with the hopper and the flask. Both vibratory means are of a conventional construction and comprise a motor 142 or 143 having a drive shaft 144 carrying at its opposite ends eccentric weights 146.

The frame 98 is mounted for vibrational movement by providing integral ears 148 which are suspended on isolation springs 150 based on a support beam 152 spanning horizontally between upright columns 36. The vibrational movement imparted by motor 142 is minimal compared with the vibration through motor 143. The motor 142 establishes a quiver that prevents any hangup of material above the plates 82, 84 associated with the sand distribution section.

The vibration imparted through motor 143 is primarily responsible for causing distribution of sand compactly about the pattern. The vibration is sufficient to prevent hangups or bridging across deep crevices and intricate formations. The sand distribution section and vibratory apparatus 140, 142 cooperate to assure that the sand is managably delivered to the pattern and that the sand ultimately completely and compactly surrounds the pattern for an effective mold.

It should be understood that the foregoing detailed description was made for purposes of showing the structure according to the present invention and the operation thereof, with no unnecessary limitations to be derived therefrom.

We claim:

1. An improved foundry apparatus of the type having a flask for holding particulate material, a pattern associated with the flask and a hopper above the pattern for delivering a flow of particulate material over the pattern, the improvement comprising:

cooling means in the hopper for cooling the particulate material being passed from the hopper, a first plate having a plurality of apertures and a second plate having a second plurality of apertures, said first and second plurality of apertures being registerable with each other to define particulate material passage areas and said particulate material passage areas being irregularly spaced relative to one another so that particulate material can be directed selectively and nonuniformly over the pattern;

means for adjustably mounting the plates relative to each other so that the apertures can be brought into adjustable registration with each other so that a desired flow rate for the particulate material over the pattern can be chosen;

means for vibrating the cooling means for advancing the particulate material toward the first plate; and means for vibrating the flask to avoid the formation of gaps and cause a substantially uniform compaction of particulate material about the pattern.

2. An improved foundry apparatus of the type having a flask for holding particulate material, a pattern associated with the flask and a hopper above the pattern for delivering a flow of particulate material over the pattern, the improvement comprising:

a first plate having a first plurality of apertures and a second plate having a second plurality of apertures, said first and second plurality of apertures being registerable with each other to define particulate material passage areas, the particulate material passage areas being non-uniform in size so that a larger particulate material volume can be directed over some portions of the pattern than others;

means for adjustably mounting the plates relative to each other so that the apertures can be brought into adjustable registration with each other so that a desired flow rate for the particulate material over the pattern can be chosen; and means for vibrating the flask to avoid the formation of gaps and cause a substantially uniform compaction of particulate material about the pattern.

3. An improved foundry apparatus of the type having a flask for holding molding sand, a pattern associated with the flask and a hopper above the pattern for delivering a flow of sand over the pattern, the improvement comprising:

a first plate having a substantially regular spaced first plurality of apertures, the apertures in the first plate being substantially uniform in area;

means mounting the first plate relative to the apparatus so that the first plate intercepts the flow of sand from the hopper;

a second plate in juxtaposition to the first plate and having a second plurality of apertures corresponding in number and location to the first plurality of apertures and at least one of the apertures in the second plate having a smaller area than a plurality of the other apertures in the second plate whereby the volume of sand delivered through each of the apertures in the first and second plates is non-uniform when registered; and means for adjustably mounting one of the plates relative to the other so that selective registration can be effected between the apertures in the first and second plates to establish a desired sand flow rate through the plates.

4. An improved foundry apparatus of the type having a flask for holding molding sand, a pattern associated with the flask and a hopper above the pattern for delivering a flow of sand over the pattern, the improvement comprising:

a first plate having a substantially regular spaced first plurality of apertures, the apertures in the first plate being substantially uniform in area;

means mounting the first plate relative to the apparatus so that the first plate intercepts the flow of sand from the hopper;

a second plate in juxtaposition to the first plate and having a plurality of apertures corresponding in location to the apertures in the first plate but fewer in number so that at least a portion of the pattern is masked from direct flow of sand from the plates; and means for adjustably mounting one of the plates relative to the other so that selective registration can be effected between the apertures in the first and second plates to establish a desired sand flow rate through the plates.

* * * * *